US007815768B2

(12) United States Patent
Herman

(10) Patent No.: US 7,815,768 B2
(45) Date of Patent: Oct. 19, 2010

(54) MULTI-LAYER WOVEN CREPING FABRIC

(75) Inventor: Jeffrey B. Herman, Bala Cynwyd, PA (US)

(73) Assignee: Albany International Corp., Albany, NY (US)

( * ) Notice: Subject to any disclaimer, the term of this patent is extended or adjusted under 35 U.S.C. 154(b) by 616 days.

(21) Appl. No.: 11/787,866

(22) Filed: Apr. 18, 2007

(65) Prior Publication Data

US 2007/0246119 A1 Oct. 25, 2007

Related U.S. Application Data

(60) Provisional application No. 60/793,049, filed on Apr. 19, 2006, provisional application No. 60/794,614, filed on Apr. 25, 2006, provisional application No. 60/808,633, filed on May 26, 2006, provisional application No. 60/808,682, filed on May 26, 2006, provisional application No. 60/809,042, filed on May 26, 2006.

(51) Int. Cl.
*D21F 7/12* (2006.01)
*D03D 11/02* (2006.01)

(52) U.S. Cl. ..... 162/113; 162/902; 139/383 A

(58) Field of Classification Search ..... 162/348, 162/358.2, 900, 902–904, 111, 113, 116; 139/383 A, 383 AA, 425 A
See application file for complete search history.

(56) References Cited

U.S. PATENT DOCUMENTS

| | | | | |
|---|---|---|---|---|
| 4,379,735 | A * | 4/1983 | MacBean | 162/348 |
| 4,943,476 | A * | 7/1990 | Sokaris | 442/187 |
| 5,361,808 | A * | 11/1994 | Bowen, Jr | 139/383 A |
| 5,366,798 | A * | 11/1994 | Ostermayer | 442/207 |
| 5,429,686 | A | 7/1995 | Chiu et al. | |
| 5,503,196 | A | 4/1996 | Josef et al. | |
| 5,985,450 | A * | 11/1999 | Keller | 428/401 |
| 5,998,310 | A * | 12/1999 | Bowen, Jr. | 442/196 |
| 6,766,817 | B2 | 7/2004 | Da Silva | |
| 6,875,314 | B2 * | 4/2005 | Korfer et al. | 162/358.2 |
| 2005/0067039 | A1 * | 3/2005 | LaFond et al. | 139/383 A |
| 2005/0241786 | A1 | 11/2005 | Edwards et al. | |
| 2006/0075737 | A1 * | 4/2006 | Hay et al. | 57/206 |

FOREIGN PATENT DOCUMENTS

| | | | |
|---|---|---|---|
| EP | 1 645 683 | A | 4/2006 |
| WO | WO 2004/033793 | A | 4/2004 |

* cited by examiner

*Primary Examiner*—Eric Hug
(74) *Attorney, Agent, or Firm*—Frommer Lawrence & Haug LLP; Ronald R. Santucci

(57) ABSTRACT

A multi-layer woven creping fabric comprising a plurality of warp yarns and weft yarns or shutes. The multi-layer woven creping fabric has a machine or roll side and a sheet contacting side. A plurality of weft yarns or shutes on the machine or roll side of the fabric which are lobed or grooved yarns and/or having weft yarn or shute diameters which are less than the warp yarn diameter.

6 Claims, 9 Drawing Sheets

Roll Side

Sheet Side

MULTI-LAYER WOVEN CREPING FABRIC

CROSS-REFERENCE TO RELATED APPLICATIONS

This application claims priority benefits from U.S. Provisional Patent Application Ser. No. 60/793,049 filed Apr. 19, 2006, entitled "Multi-Layer Process Fabrics Having Lobed or Grooved Machine Side Weft Yarns to Prevent Rewet"; and U.S. Provisional Patent Application Ser. No. 60/794,614 filed Apr. 25, 2006 entitled "Multi-Layer Process Fabrics Having Lobed or Grooved Machine Side Weft Yarns to Prevent Rewet"; and U.S. Provisional Patent Application Ser. No. 60/808,633 filed May 26, 2006 entitled "Impression or Creping Fabric"; and U.S. Provisional Patent Application Ser. No. 60/808,682 filed May 26, 2006 entitled "Multi-Layer Process Fabrics Having Lobed or Grooved Machine Side Weft Yarns to Prevent Rewet"; and U.S. Provisional Patent Application Ser. No. 60/809,042 filed May 26, 2006 entitled "Impression or Creping Fabric".

BACKGROUND OF THE INVENTION

1. Field of the Invention

The instant invention is directed toward endless fabrics, and more particularly, fabrics used as multi-layer woven creping fabrics in the production of paper products. More particularly, the instant invention is directed to creping fabrics used in the production of products such as paper and sanitary tissue and towel products.

2. Description of the Prior Art

Soft, absorbent disposable paper products, such as facial tissue, bath tissue and paper toweling, are a pervasive feature of contemporary life in modern industrialized societies. While there are numerous methods for manufacturing such products, in general terms, their manufacture begins with the formation of a cellulosic fibrous web in the forming section of a papermaking machine. The cellulosic fibrous web is formed by depositing a fibrous slurry, that is, an aqueous dispersion of cellulose fibers, onto a moving forming fabric in the forming section of a papermaking machine. A large amount of water is drained from the slurry through the forming fabric, leaving the cellulosic fibrous web on the surface of the forming fabric.

Further processing and drying of the cellulosic fibrous web generally proceeds using one of two well-known methods. These methods are commonly referred to as wet-pressing and throughdrying. In wet pressing, the newly formed cellulosic fibrous web is transferred to a press fabric and proceeds from the forming section to a press section that includes at least one press nip. The cellulosic fibrous web passes through the press nip(s) supported by the press fabric, or, as is often the case, between two such press fabrics. In the press nip(s), the cellulosic fibrous web is subjected to compressive forces which squeeze water therefrom. The water is accepted by the press fabric or fabrics and, ideally, does not return to the fibrous web or paper.

After pressing, the paper is transferred, by way of, for example, a press fabric, to a rotating Yankee dryer cylinder that is heated, thereby causing the paper to substantially dry on the cylinder surface. The moisture within the web as it is laid on the Yankee dryer cylinder surface causes the web to adhere to the surface, and, in the production of tissue and toweling type paper products, the web is typically creped from the dryer surface with a creping blade. The creped web can be further processed by, for example, passing through a calender and wound up prior to further converting operations. The action of the creping blade on the paper is known to cause a portion of the interfiber bonds within the paper to be broken up by the mechanical smashing action of the blade against the web as it is being driven into the blade. However, fairly strong interfiber bonds are formed between the cellulosic fibers during the drying of the moisture from the web. The strength of these bonds is such that, even after conventional creping, the web retains a perceived feeling of hardness, a fairly high density, and low bulk and water absorbency.

In order to reduce the strength of the interfiber bonds that are formed by the wet-pressing method, throughdrying can be used. In the throughdrying process, the newly formed cellulosic fibrous web is transferred to a through-air-drying (TAD) fabric by means of an air flow, brought about by vacuum or suction, which deflects the web and forces it to conform, at least in part, to the topography of the TAD fabric. Downstream from the transfer point, the web, carried on the TAD fabric, passes through and around through-air-dryer, where a flow of heated air, directed against the web and through the TAD fabric, dries the web to a desired degree. Finally, downstream from the through-air-dryer, the web may be transferred to the surface of a Yankee dryer for further and complete drying. The fully dried web is then removed from the surface of the Yankee dryer with a doctor blade, which foreshortens or crepes the web thereby further increasing its bulk. The foreshortened web is then wound onto rolls for subsequent processing, including packaging into a form suitable for shipment to and purchase by consumers.

In the TAD process, the lack of web compaction, such as would occur in the wet-pressing process when the web is pressed in a nip while on the fabric and against the Yankee drying cylinder when it is transferred thereto, reduces the opportunity for strong interfiber bonds to form, and results in the finished tissue or towel product to have greater bulk than can be achieved by conventional wet-pressing. Generally, however, the tensile strength of webs formed in the through-air drying process is not adequate for a finished consumer product, and various types of chemical additives are typically introduced into the web prior to and/or during the forming operation to achieve the desired strength while still retaining most of the bulk of the original product.

As noted above, there are many methods for manufacturing bulk tissue products, and the foregoing description should be understood to be an outline of the general steps shared by some of the methods. For example, the use of a Yankee dryer is not always required, as, in a given situation, foreshortening may not be desired, or other means, such as "wet creping", may have already been taken to foreshorten the web.

Other process and machine configuration variations of either wet pressing or through-air-drying are also to be considered here. For example, in some cases, no creping doctor is employed when the sheet is removed from the dryer surface. Further, there are processes that are alternatives to the through-air-drying process that attempt to achieve "TAD-like" tissue or towel product properties without the TAD units and high energy costs associated with the TAD process.

The properties of bulk, absorbency, strength, softness, and aesthetic appearance are important for many products when used for their intended purpose, particularly when the fibrous cellulosic products are facial or toilet tissue or paper towels. To produce a paper product having these characteristics, a fabric will often be constructed such that the sheet contact surface exhibits topographical variations. These topographical variations are often measured as plane differences between woven yarn strands in the surface of the fabric. For example, a plane difference is typically measured as the difference in height between a raised weft or warp yarn strand or as the difference in height between machine-direction (MD)

knuckles and cross-machine direction (CD) knuckles in the plane of the fabric's surface. Often, the fabric structure will exhibit pockets in which case plane differences may be measured as a pocket depth.

It should be appreciated that these creping fabrics may take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it is dried.

The instant invention provides a fabric that may reduce or even prevent rewetting of a product being formed thereon during such operation.

SUMMARY OF THE INVENTION

It is therefore a principal object of the invention to provide a multi-layer woven creping fabric that minimizes and even eliminates rewetting of a paper product being formed thereon.

It is another object of the invention to provide a multi-layer woven creping fabric having lobed or grooved Weft yarns or shutes on its machine or roll side It is a further object of the invention to provide a creping fabric having deeper pockets than conventional single layer fabrics.

Yet another object of the invention is to provide a creping fabric that may result in a web formed thereon having a higher caliper and lower density.

A further object of the invention is to provide a multi-layer woven creping fabric that not only provides for an improved paper product being produced thereon but may also allow for the process to be run at a wide array of percentages of fabric crepe and basis weight and thus may increase the range of operating process parameters and/or increase the amount of recycled fiber content.

A still further object of the invention is to provide an 8-shed multi-layer woven creping fabric having lobed or grooved weft yarns on the machine or roll side and non-lobed or round weft yarns on the sheet contacting side.

Yet another object of the invention is to provide a multi-layer woven creping fabric having weft yarns or shutes with a smaller diameter than the diameter of the warp yarns.

These and other objects and advantages are provided by the instant invention. In this regard, one aspect of the instant invention is directed to a multi-layer woven creping fabric having lobed or grooved weft yarns or shutes on the roll side surface of the fabric. In addition, another aspect of the instant invention is directed to a multi-layer woven creping fabric having weft yarns or shutes with a smaller diameter than the warp yarns. Further, a combination of such yarn arrangements is also envisioned. The fabric structures of the instant invention are desirable over prior art designs in that including the lobed or grooved weft yarns on the roll side of the fabric and/or having weft yarns or shutes with a smaller diameter than the warp yarns, may reduce and even eliminate the possibility of residual fabric water rewetting a paper product being produced thereon.

In addition, multi-layer woven creping fabrics of the instant invention will have deeper pockets than conventional single layer fabrics. The deeper pockets are the result of the fabric being a multi-layer structure and having a warp yarn to weft yarn or shute plane difference. The deeper pockets may result in a paper web having a much higher caliper and a much lower density when a vacuum is applied than a paper web produced on a prior art fabric.

Fabrics of the instant invention can find application in papermaking machines as impression fabrics, creping fabrics or other applications which will be apparent to one skilled in the art.

For a better understanding of the invention, its operating advantages and specific objects attained by its uses, reference is made to the accompanying descriptive matter in which preferred embodiments of the invention are illustrated in the accompanying drawings in which corresponding components are identified by the same reference numerals.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PREFERRED EMBODIMENTS

The instant invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

The instant invention relates to multi-layer woven creping fabrics used in the production of soft, absorbent, disposable paper products, such as facial tissue, bath tissue and paper toweling. The instant fabrics may minimize or even prevent rewetting of a paper product or sheet/web produced thereon.

Figure 2:
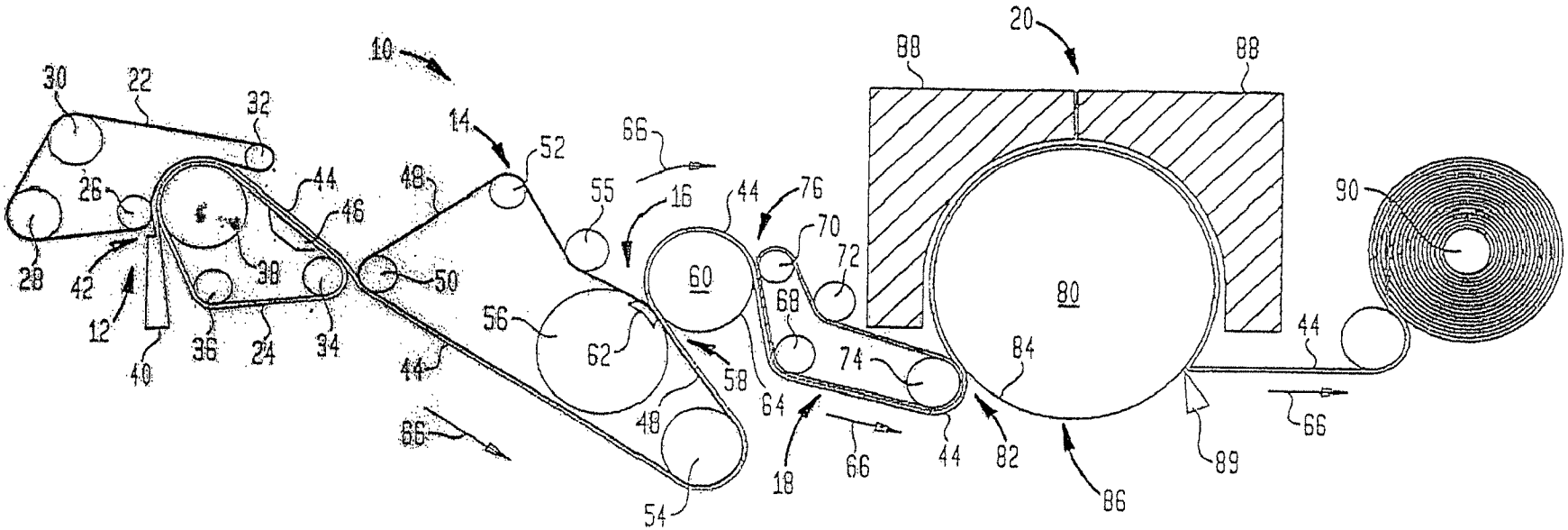
FIG. 2 is a schematic diagram of a papermaking machine used in a papermaking manufacturing process.

The present invention provides for a multi-layer woven creping fabric for use in the apparatus shown in FIG. 2 which may reduce the manufacturing time and costs associated with the production of paper products. Production time and costs may be reduced because fabrics of the instant invention may reduce and even prevent water removed from a paper web from rewetting the web. Therefore, the paper web will be dried quickly and more efficiently.

In addition, fabrics constructed according to the instant invention improve performance on the papermaking machine because sheet holes are minimized or even prevented, which in turn allows it to operate at higher draw levels or at lower basis weights without sheet holes. Also, higher recycled fiber contents can also be used and still obtain the desired paper web property.

In addition, fabrics constructed in accordance with the instant invention will result in deeper pocket resulting in a paper web with higher bulk absorbency.

Figure 1:
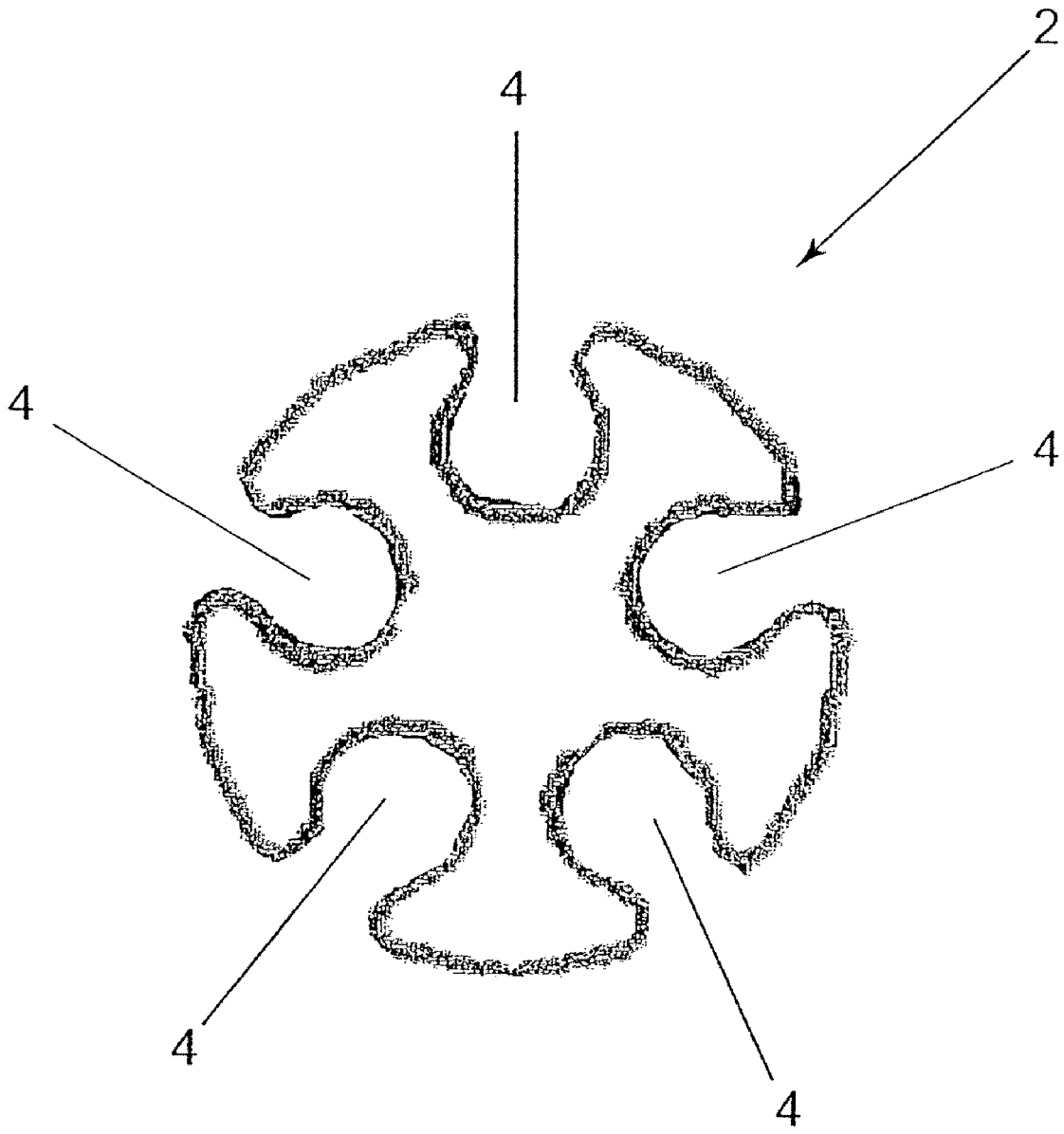
FIG. 1 is a cross-sectional view of a lobed or grooved weft yarn according to one aspect of the instant invention.

As used herein, lobed or grooved weft yarns are terms used to describe the yarns included in certain embodiments of the instant invention. As depicted in FIG. 1, which is a non-limiting example of a lobed or grooved yarn, the lobed or grooved weft yarns 2 comprise a plurality of lobes or grooves 4. Additionally, lobed weft yarns of the instant invention may be described as being striated, contoured or non-round. Furthermore, the instant invention will be described in terms of a flat-woven product. Therefore, as used herein, the weft yarns are the cross-machine direction (CD) yarns and the warp yarns are the machine direction (MD) yarns. Lastly, the terms "weft" and "shute" are used interchangeably and are meant to refer to CD yarns. Also, flat woven fabrics are rendered endless through the use of seams or woven joints. An advantage of multi-layer woven fabrics is that they have a machine seaming capability with a relatively uniform seam area compared to that of single layer fabrics.

Preferred embodiments of the invention will now be described in the context of full width, full length fabric structures for use as a creping fabric in the transfer/drying section of a papermaking machine.

In developing creping fabric options for a papermaking process used to make absorbent paper products such as those previously described, a unique and unexpected result was obtained. A relevant process is disclosed in PCT Publication No. WO 2004/033793 and U.S. Patent Application Publication No. 2005/0241786, the entire contents of which are incorporated herein by reference. As depicted in FIG. 2, an embodiment of the manufacturing process and a papermaking machine 10 used in the process are described as follows.

The papermaking machine 10 has a conventional twin wire forming section 12, a fabric run 14, a shoe press section 16, a creping fabric 18 and a Yankee dryer 20. Forming section 12 includes a pair of forming fabrics 22, 24 supported by a plurality of rolls 26, 28, 30, 32, 34, 36 and a forming roll 38. A headbox 40 provides papermaking furnish to a nip 42 between forming roll 38 and roll 26 and the fabrics. The furnish forms a web 44 which is dewatered on the fabrics with the assistance of a vacuum, for example, by way of vacuum box 46.

The web 44 is advanced to a papermaking press fabric 48, which is supported by a plurality of rolls 50, 52, 54, 55, the fabric being in contact with a shoe press roll 56. The web 44 is of a low consistency as it is transferred to the fabric 48. Transfer may be assisted by vacuum, for example, roll 50 may be a vacuum roll if so desired or a pickup or vacuum shoe as is known in the art. As the web reaches the shoe press roll 56, it may have a consistency of 10 to 25 percent, preferably 20 to 25 percent or so as it enters nip 58 between shoe press roll 56 and transfer roll 60. Transfer roll 60 may be a heated roll if so desired. Instead of a shoe press roll, roll 56 could be a conventional suction pressure roll. If a shoe press is employed it is desirable and preferred that roll 54 is a vacuum roll to more effectively remove water form the fabric prior to the fabric entering the shoe press nip since water from the furnish will be pressed into the fabric in the shoe press nip. In any case, using a vacuum roll 54 is typically desirable to ensure the web remains in contact with the fabric during the direction change as one of skill in the art will appreciate from the diagram.

Web 44 is wet-pressed on the fabric 48 in nip 58 with the assistance of pressure shoe 62. The web is thus compactively dewatered at nip 58 typically by increasing the consistency by 15 or more percentage solids at this stage of the process. The configuration shown at nip 58 is generally termed a shoe press. In connection with the present invention, cylinder 60 is operative as a transfer cylinder which operates to convey web 44 at high speed, typically 1000 fpm to 6000 fpm to the creping fabric 18.

Cylinder 60 has a smooth surface 64 which may be provided with an adhesive and/or release agents if needed. Web 44 is adhered to transfer surface 64 of cylinder 60 which is rotating at a high angular velocity as the web 44 continues to advance in the machine-direction indicated by arrows 66. On the cylinder 60, web 44 has a generally random apparent distribution of fiber. Direction 66 is referred to as the machine-direction (MD) of the web as well as that of papermaking machine 10, whereas the cross-machine-direction (CD) is the direction in the plane of the web perpendicular to the MD.

Web 44 enters nip 58 typically at consistencies of 10 to 25 percent or so and is dewatered and dried to consistencies of from about 25 to about 70 percent by the time it is transferred to creping fabric 18 as shown in the diagram.

Creping fabric 18 is supported on a plurality of rolls 68, 70, 72 and a press nip roll 74 and forms a fabric crepe nip 76 with transfer cylinder 60 as shown. The creping fabric 18 defines a creping nip over the distance in which creping fabric 18 is adapted to contact roll 60, that is, applies significant pressure to the web 44 against the transfer cylinder 60. To this end, backing (or creping) roll 70 may be provided with a soft deformable surface which will increase the length of the creping nip and increase the fabric creping angle between the fabric and the sheet and the point of contact. Alternatively, a shoe press roll could be used as roll 70 to increase effective contact with the web in high impact fabric creping nip 76 where web 44 is transferred to creping fabric 18 and advanced in the machine-direction. By using different equipment at the creping nip 76, it is possible to adjust the fabric creping angle or the takeaway angle from the creping nip. Thus, it is possible to influence the nature and amount of redistribution of fiber, delamination/debonding which may occur at fabric creping nip 76 by adjusting these nip parameters.

After fabric creping, the web 44 continues to advance along machine direction 66 where it is pressed onto Yankee cylinder 80 at transfer nip 82. Transfer at nip 82 occurs at a web consistency of generally from about 25 to about 70 percent. At these consistencies, it is difficult to adhere the web 44 to surface 84 of Yankee cylinder 80 firmly enough to thoroughly remove the web 44 from the fabric. This aspect of the process is important, particularly when it is desired to use a high velocity drying hood as well as maintain high impact creping conditions. In this connection, it is noted that conventional through-air-drying (TAD) processes do not employ high velocity hoods since sufficient adhesion to the Yankee cylinder 80 is not achieved. In accordance with the process, the use of particular adhesives cooperates with a moderately moist web (25 to 70 percent consistency) to adhere it to the Yankee cylinder 80 sufficiently to allow for high velocity operation of the system and high jet velocity impingement air drying.

The web 44 is dried on Yankee cylinder 80 which is a heated cylinder and by high jet velocity impingement air in Yankee hood 88. As the cylinder 80 rotates, web 44 is creped from the cylinder by creping doctor 89 and wound on a take-up roll 90.

Figure 3B:
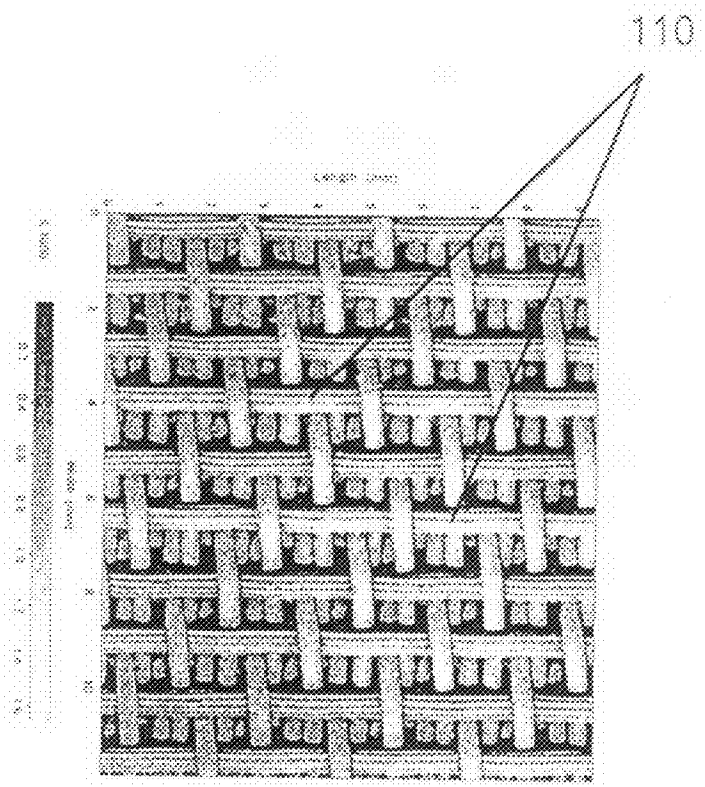
FIG. 3B is a surface photograph of a roll side of a fabric constructed according to one aspect of the instant invention.
Figure 3A:
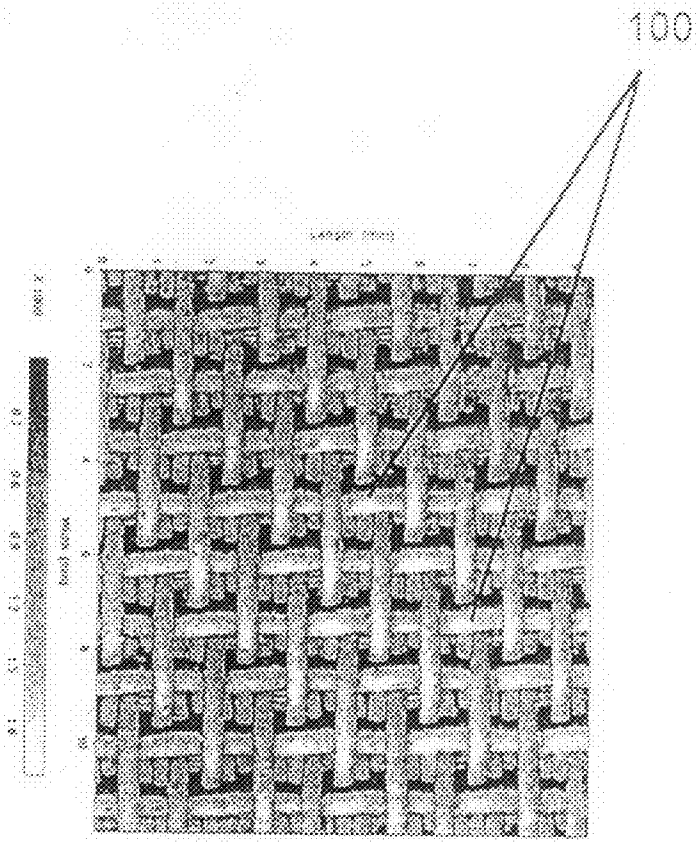
FIG. 3A is a surface photograph of a sheet contacting side of a fabric constructed according to one aspect of the instant invention.
Figure 4:
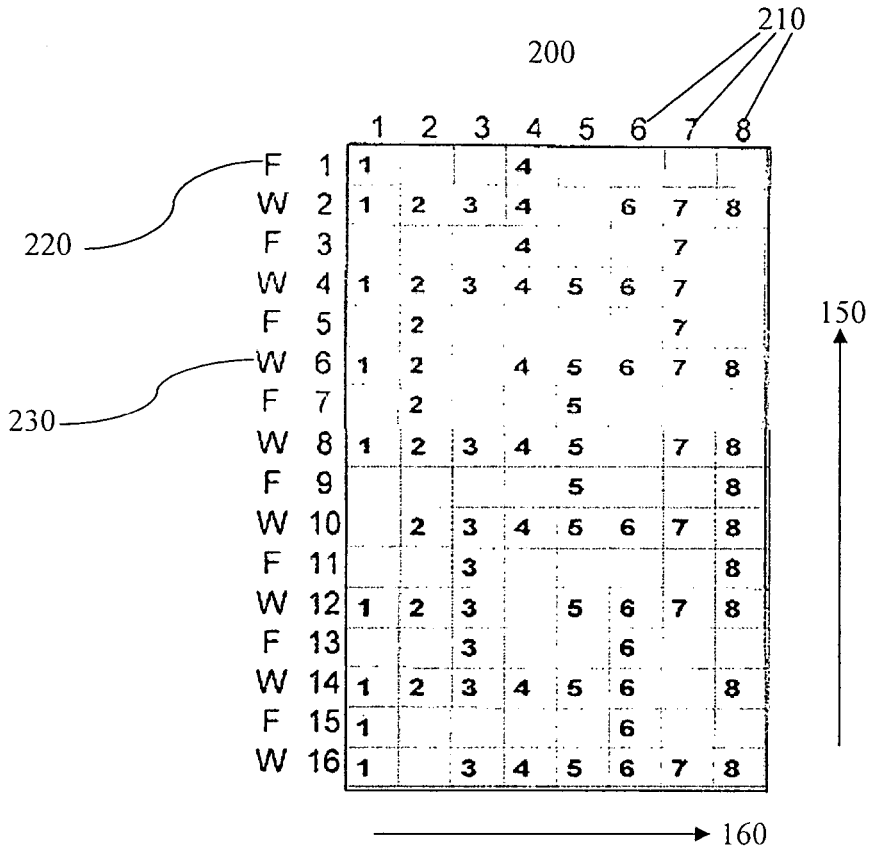
FIG. 4 is a weave pattern for an 8-shed multi-layer woven creping fabric constructed according to one aspect of the instant invention.
Figure 5:
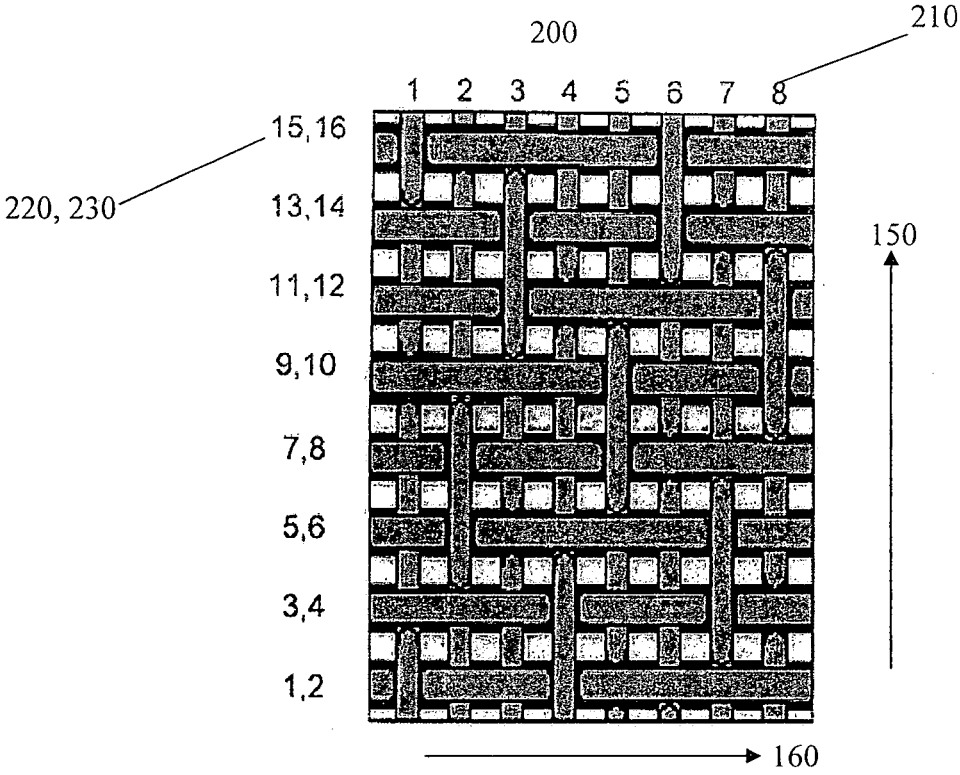
FIG. 5 is a schematic of the weave pattern depicted in FIG. 4.
Figure 6:
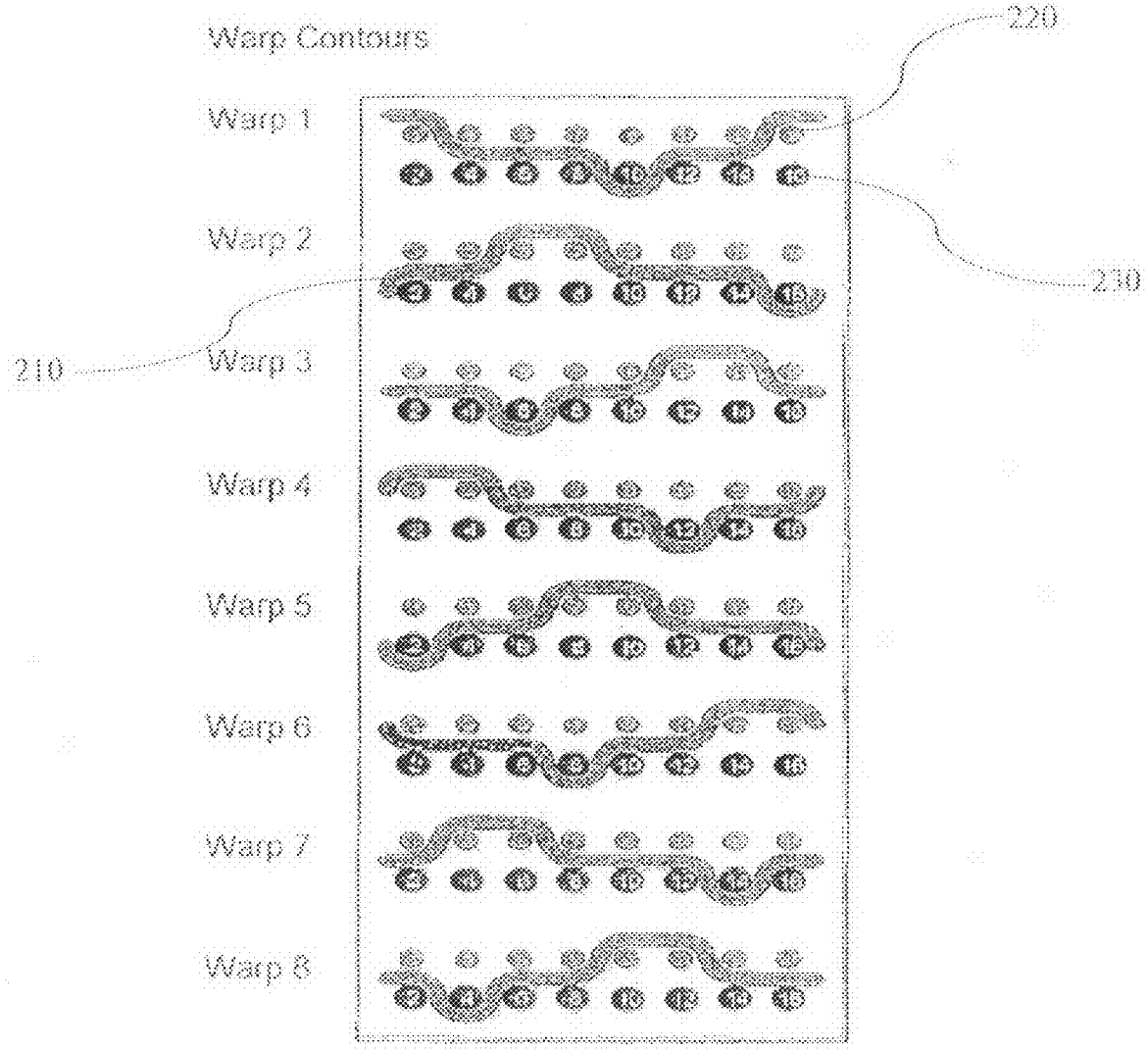
FIG. 6 depicts the warp contours for the weave pattern depicted in FIG. 4.
Figure 7:
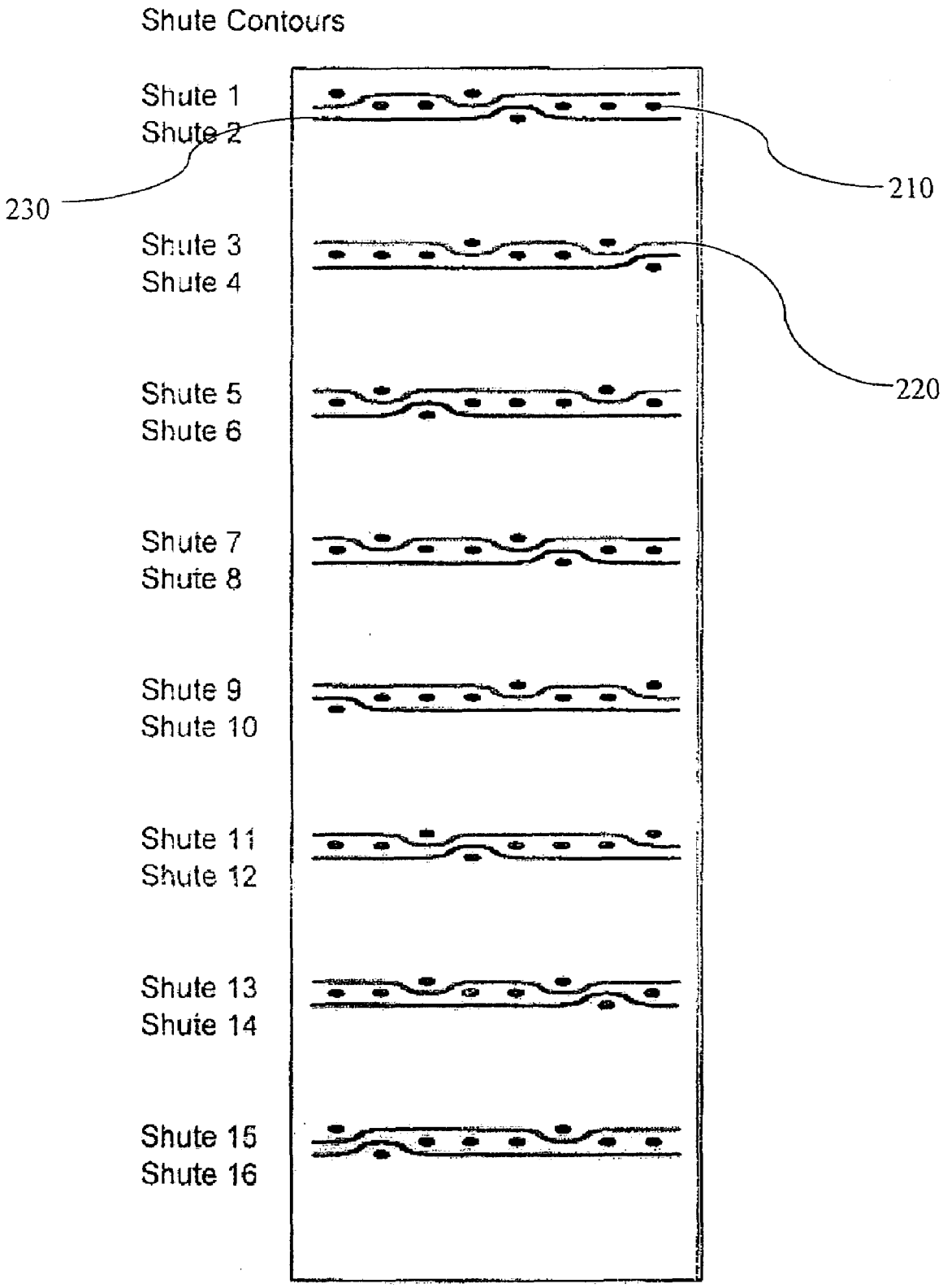
FIG. 7 depicts the weft contours for the weave pattern depicted in FIG. 4.

One embodiment of a fabric design for use as creping fabric 18 in the above described process as depicted FIGS. 3-5, is an 8-shed multi-layer woven creping fabric with lobed or grooved weft yarns in the non-sheet contacting or machine side surface.

Generally, a creping fabric has two sides: a sheet contacting side and a machine or roll side. The former is so-called because it is the side of the fabric that faces the newly formed paper web. The latter is so-called because it is the side of the fabric that passes over and is in contact with the rolls on the papermaking machine. In the process, the creping fabric is installed on the papermaking machine in the manner that is shown in FIG. 3A. The sheet contacting side contains the non-lobed or round weft yarns 100 and as shown in FIG. 3B, the machine side contains the lobed or grooved weft yarns 110.

As previously discussed, in the manufacturing process, after the web 44 is transferred to the backing roll 60, the web 44 is picked up on the creping fabric 18 running at a much slower rate of speed. After pickup, there is a vacuum box (not shown) to pull the web deeper into the creping fabric 18 and to remove additional residual water from the paper web by pulling the residual water into (and through) the interior of the creping fabric 18. Conventional logic would indicate that any residual water left in the creping fabric 18 after showering would rewet the web 44 after pickup. In this embodiment, however, it does not appear to be the case with the creping fabric 18 installed on the papermaking machine such that the lobed or grooved weft yarns are disposed on the roll side. Moisture samples suggest that rewet is minimal if not totally eliminated. It has been observed that the fabric itself is running wet on the inside, which again is inconsistent with no rewetting. Additionally, drips falling on the inside of the fabric do not create sheet holes, which is usually the case with single layer fabric designs. Consequently, no rewetting of the web 44, is an unexpected result. Thus, this unexpected result may be a function of the woven multi-layer creping fabric 18 being installed on the papermaking machine with the lobed or grooved weft yarns facing the roll side.

It is believed that the multi-layer design having lobed or grooved weft yarns on the machine side may be the reason why residual fabric water reentering the web after it is removed is minimal or altogether prevented or eliminated. The reasons for this may be as follows. One reason may be due to the lobed or grooved yarns having an increased surface area over round yarns. Because of this increased surface area, surface tension between the fabric and the residual water may be greater, thus reducing the ability of the residual water to exit the fabric and reenter the paper web. Another reason may be because the use of the lobed or grooved weft yarns may change the relationship between the yarns at the crossover points. For example, if the yarns are both circular, the distance between the yarns at the crossovers continues to get smaller and smaller (approaching microns) and this small distance may create capillary forces that hold the water in the fabric. Thus, using lobed or grooved weft yarns on the machine side changes the geometry at the crossover points of the yarns, which may reduce capillary forces. Another possibility may be that the geometry created at the crossovers due to the lobed yarn can trap water or the geometry creates the pockets which prevents them from holding or retaining water or both.

Therefore, it is believed that the instant invention is not limited to the specific 8-shed multi-layer woven creping fabric design disclosed above. Instead, any multi-layer woven creping fabric having lobed or grooved weft yarns on its machine side, may also minimize or even prevent rewetting of a paper product produced thereon.

A fabric in accordance with one aspect of the instant invention may be constructed using an 8-shed multi-layer weave pattern as depicted in FIGS. 4-7. FIG. 4 is a schematic plan view of the paper side or sheet contacting surface of a weave pattern 200 for the fabric shown in FIGS. 3A and 3B. As depicted in FIG. 4, the machine direction is indicated by arrow 150 and the cross-machine direction is indicated by arrow 160. Each column corresponds to a warp yarn 210 and each row corresponds to a weft yarn 220, 230. Each box indicates a knuckle (where warp and weft yarns cross over one another). The number in the box indicates that at that position in the weave, that numbered warp yarn 210 is on the sheet contacting surface of the fabric. Accordingly, the empty boxes indicate locations where a warp yarn 210 passes under a weft yarn 220 and will therefore not be in contact with a sheet being formed thereon.

The weave pattern shown in FIG. 4 comprises two sets of weft yarns, namely the contacting side weft yarns 220 and roller side weft yarns 230, and one set of warp yarns 210. The lobed or grooved weft yarns used in forming the fabric according to the instant invention are located on the roll side of the fabric which may reduce or even prevent residual fabric water from re-entering and rewetting a paper web formed thereon.

In FIG. 4, the numbers below each warp yarn 210 indicate the contoured pattern followed by the number for that warp yarn. Each warp yarn corresponds to a column in FIG. 4. For example, warp yarn 1 corresponds to the pattern shown in the first column in FIG. 4. As shown by the contour pattern for warp yarn 1, the warp yarn passes over weft yarns 1, 2 under weft yarn 3, over weft yarn 4, under weft yarn 5, over weft yarn 6, under weft yarn 7, over weft yarn 8, under weft yarns 9-11, over weft yarn 12, under weft yarn 13 and over weft yarns 14-16. Accordingly, in the first column, the boxes corresponding to weft yarns 1, 2 and 14-16 indicate that warp yarn 1 forms knuckles where it passes over the weft yarns in the contour pattern. Alternatively, the boxes in FIG. 4 are blank where the warp yarn passes under the weft yarn.

FIG. 5 shows a schematic of a fabric corresponding to the weave pattern 200 depicted in FIG. 4. As in FIG. 4, the numbers to the right of each weft yarn contour pattern indicate the number of the weft yarn followed by the contour pattern number for that weft yarn. Each weft yarn corresponds to a row in FIG. 4. For example, weft yarn 1 corresponds to the pattern shown in the first row in FIG. 4. As shown by the contour pattern for weft yarn 1, the weft yarn passes under warp yarn 1, over warp yarns 2 and 3, under warp yarn 4, and over warp yarns 5-8. Accordingly, in row 2 of FIG. 4, the boxes corresponding to warp yarns 1, 4, and 6-8 indicate those warp yarns form knuckles where they pass over weft yarn 1 in the contour pattern. As above, the boxes in FIG. 4 are blank where the warp yarn passes under the weft yarn.

Figure 8:
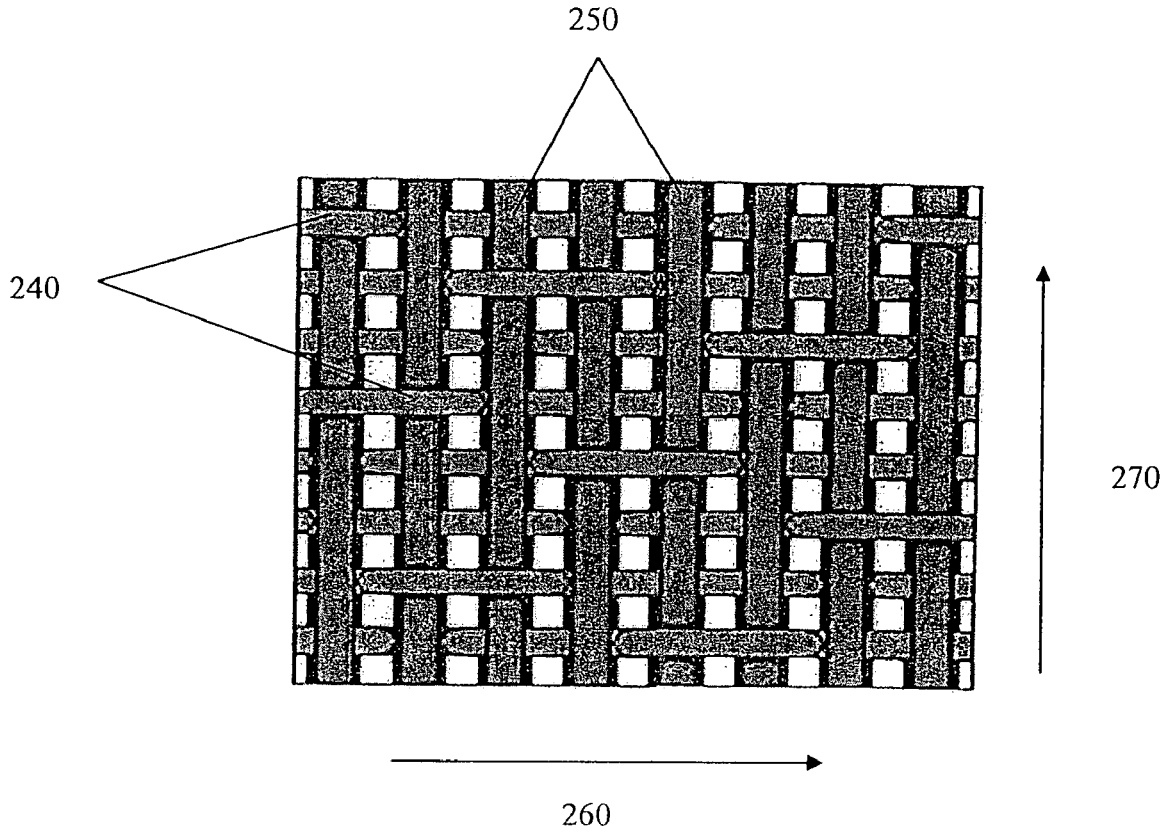
FIG. 8 is a schematic of a weave pattern, according to one aspect of the instant invention.

Another embodiment of a multi-layer woven creping fabric design for use as, for example, a creping fabric 18 in the above-described process is depicted in FIG. 8, which is an 8-shed multi-layer woven creping fabric having weft yarns or shutes 240 with a smaller diameter than the diameter of the warp yarns 250. In FIG. 8, the weft direction is indicated by arrow 260 and the warp direction is indicated by arrow 270. According to the instant embodiment, the creping fabric 18 can be constructed having 0.5 mm warp yarns 250 and 0.4 mm weft yarns or shutes 240. In addition, an impression or creping fabric 18 can be constructed with 0.64 mm warp yarns 250 and 0.5 mm shutes 240 or 0.35 mm warp yarns 250 and 0.25 mm shutes 240. It appears that having shutes 240 with a smaller diameter than the warp yarns 250, results in better fabric performance on the papermaking machine because the fabric reduces or even eliminates sheet holes.

Note that the smaller diameter weft yarns or shutes may comprise or be used in addition to the lobed or grooved yarns aforementioned.

Figure 9:
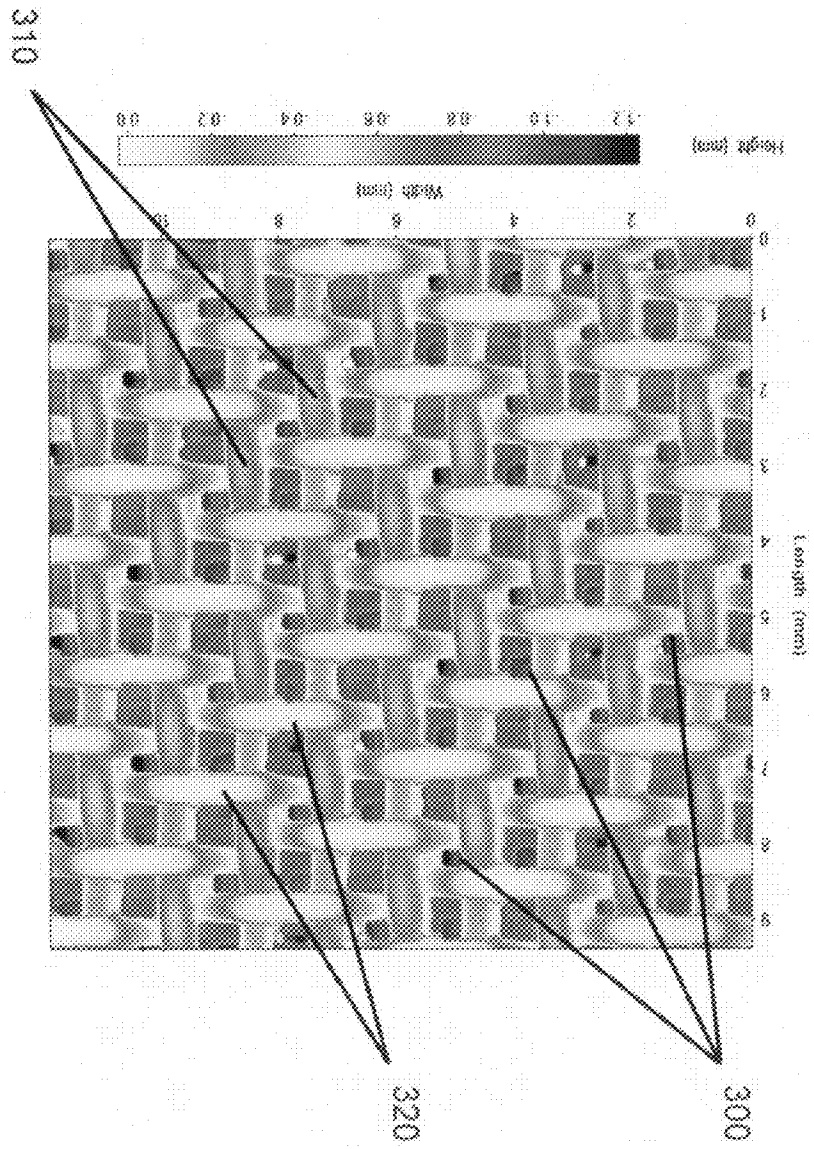
FIG. 9 is a 3-D surface image of the fabric of FIG. 4.

FIG. 9 is a top view, 3-D surface depth image of a fabric of the instant invention constructed in the manner described above taken with a MarSurf TS 50 high-precision optical 3-D measuring instrument manufactured by Mahr GmbH Gottingen, Gottingen, Germany. As can be seen in FIG. 9, the dark areas 300 represent pockets that are much deeper than conventional woven impression fabrics. Also, as can be seen in the figure, the weft yarns or shutes 310 are located just below the top surface plane of the fabric and the warp yarns 320 are located at the top surface plane of the fabric. Therefore, because both the weft yarns 310 and the warp yarns 320 are not located in the top surface plane of the fabrics and, in combination with being a multi-layer structure, the result is much deeper pockets in the fabric as compared to a conventional single layer fabric.

Figure 10:
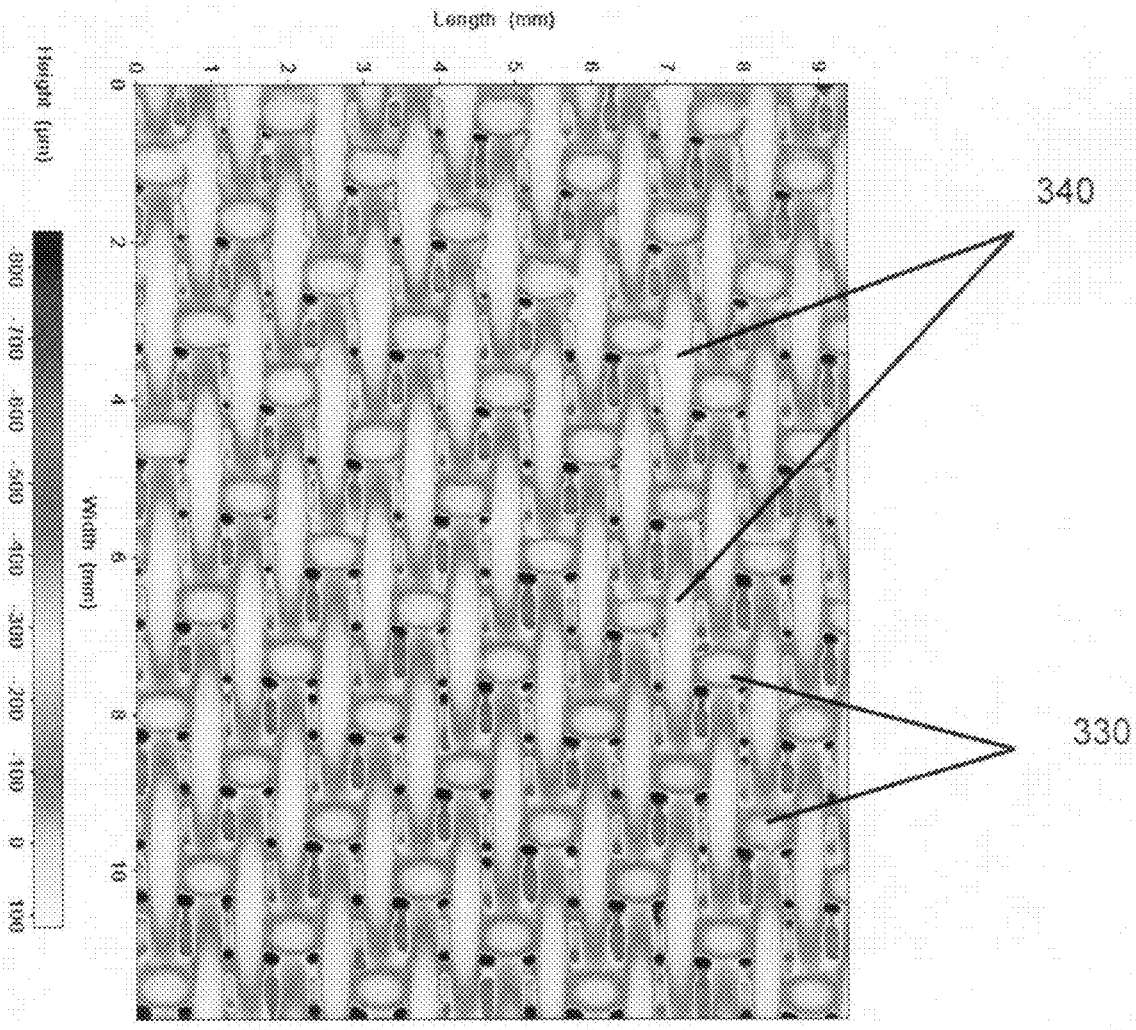
FIG. 10 is a 3-D surface image of a conventional impression fabric.

FIG. 10 is a top view 3-D surface depth image of a conventional impression fabric known in the art taken with a MarSurf TS 50 high-precision optical 3-D measuring instrument manufactured by Mahr GmbH Gottingen, Gottingen, Germany. As can be seen in the figure, the fabric of FIG. 10 does not have the dark areas that the fabric of FIG. 9 has and consequently, does not have the deeper pockets that the fabric of FIG. 9 has. Furthermore, as can be seen in FIG. 10, both the weft yarns 330 and the warp yarns 340 are located in the top surface plane of the fabric, which results in a fabric with pockets that are shallower than the pockets of the instant invention.

The use of a fabric as described herein may result with a web with much higher caliper and much lower density, an unexpected result. The higher caliper and lower density results in a softer paper product having an increased absorbency, both of which are very desired characteristics.

Lastly, the instant fabric may allow the process to be run at a wider array of percent of fabric crepe, basis weight and/or increased recycled fiber content and may produce significant value by increasing the range of operating process parameters.

Although a preferred embodiment of the present invention and modifications thereof have been described in detail herein, it is to be understood that this invention is not limited to this precise embodiment and modifications, and that other modifications and variations may be effected by one skilled in the art without departing from the spirit and scope of the invention as defined by the appended claims.

What is claimed is:

1. A multi-layer woven creping fabric comprising:

a plurality of warp yarns;

a plurality of weft yarns or shutes;

a machine or roll contact side; and a sheet contacting side;

wherein weft yarns or shutes on the machine or roll contact side of the fabric are lobed or grooved yarns, wherein said plurality of warp yarns are located on a top surface plane of the fabric and a set of weft yarns or shutes are located below the top surface plane of the fabric.

2. The multi-layer woven creping fabric as claimed in claim 1, wherein said multi-layer woven fabric is an 8-shed multi-layer weave.

3. The multi-layer woven creping fabric as claimed in claim 2, wherein the multi-layer weave comprises at least two sets of weft yarns.

4. The multi-layer woven creping fabric as claimed in claim 3, wherein a first set of weft yarns is disposed on the machine or roll contact side of the fabric and a second set of weft yarns is disposed on the sheet contacting side of the fabric.

5. The multi-layer woven creping fabric as claimed in claim 4 wherein said first set and/or second set of weft yarns have a diameter which is less than a diameter of the plurality of warp yarns.

6. The woven creping fabric as claimed in claim 1, wherein said fabric has deeper pockets than a single layer fabric.

* * * * *